US008965232B2

(12) United States Patent
Shiga

(10) Patent No.: US 8,965,232 B2
(45) Date of Patent: Feb. 24, 2015

(54) POSITIONING DEVICE TO POSITION A FIRST MEMBER RELATIVE TO A SECOND MEMBER AND IMAGE FORMING APPARATUS INCORPORATING SAME

(71) Applicant: Yuuki Shiga, Hyogo (JP)

(72) Inventor: Yuuki Shiga, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 28 days.

(21) Appl. No.: 13/898,894

(22) Filed: May 21, 2013

(65) Prior Publication Data

US 2013/0322909 A1 Dec. 5, 2013

(30) Foreign Application Priority Data

Jun. 5, 2012 (JP) ..... 2012-128121

(51) Int. Cl.
*G03G 15/16* (2006.01)
*G03G 21/16* (2006.01)

(52) U.S. Cl.
CPC ..... *G03G 21/16* (2013.01); *G03G 21/1647* (2013.01); *G03G 21/168* (2013.01); *G03G 2215/0132* (2013.01); *G03G 2221/1684* (2013.01)
USPC ..... 399/74

(58) Field of Classification Search
USPC ..... 399/74, 110, 121
See application file for complete search history.

(56) References Cited

U.S. PATENT DOCUMENTS 7,643,186 B2 * 1/2010 Hozono et al. ..... 358/504
2011/0229197 A1 * 9/2011 Tada et al. ..... 399/111

FOREIGN PATENT DOCUMENTS

JP 11-065397 3/1999
JP 2001-034032 2/2001
JP 2005-070676 3/2005
JP 2008-286970 11/2008

* cited by examiner

*Primary Examiner* — Quana M Grainger
(74) *Attorney, Agent, or Firm* — Oblon, Spivak, McClelland, Maier & Neustadt, L.L.P.

(57) ABSTRACT

A positioning device to position a first member relative to a second member includes two convex parts disposed on a side of the first member and apart from each other; and positioning portions disposed on a side of the second member so as to contact the convex parts, each of which is disposed apart from each other and opposed to the two convex parts. The positioning portions includes two planar portions disposed substantially perpendicularly relative to a direction to allow the first member to approach the second member; and a slanted portion disposed in the vicinity of one of the two planar portions and angled with respect to a direction to allow the first member to approach the second member. The second member is an endless belt, on which an image pattern for detection is formed, and the first member is a sensor to detect the image pattern formed on the endless belt.

20 Claims, 14 Drawing Sheets

POSITIONING DEVICE TO POSITION A FIRST MEMBER RELATIVE TO A SECOND MEMBER AND IMAGE FORMING APPARATUS INCORPORATING SAME

CROSS-REFERENCE TO RELATED APPLICATION

The present application claims priority pursuant to 35 U.S.C. §119 from Japanese patent application number 2012-128121, filed on Jun. 5, 2012, the entire disclosure of which is incorporated by reference herein.

BACKGROUND

1. Technical Field

The present invention relates to a positioning device to position a member such as a sensor relative to an intermediate transfer belt, and an image forming apparatus including the positioning device.

2. Related Art

In image forming apparatuses such as a copier, a printer, a facsimile machine, or a multifunction apparatus including several of the capabilities of the above devices, as a method to properly control a density or a position of a toner image, an image pattern is formed on a surface of an intermediate transfer belt and is detected by a sensor serving as a pattern detector.

In order to improve precision in the detection by the sensor, the sensor needs to be positioned close to the surface of the intermediate transfer belt as a detection target. However, when the sensor is positioned close to the surface of the intermediate transfer belt, the surface may contact a detection surface of the sensor when the intermediate transfer belt is replaced with a new one, causing damage to the sensor. JP-2001-34032-A discloses a technique to dispose the sensor to be separable from the intermediate transfer belt.

When the sensor is disposed separable from the intermediate transfer belt, a positioning device needs to be provided for precise positioning of the sensor. However, due to accumulated dimensional tolerances of each part and parts assembly errors, the sensor is not positioned with consistently high precision, thereby degrading sensor detection precision.

Therefore, the present invention aims to provide an optimal positioning device capable of properly positioning the sensor relative to the intermediate transfer belt.

SUMMARY

The present invention provides a positioning device to position a first member relative to a second member including: two convex parts disposed on a side of the first member and apart from each other; and positioning portions disposed on a side of the second member so as to contact the convex parts, each of which is disposed apart from each other and opposed to the two convex parts. In the optimal positioning device, the positioning portions includes two planar portions disposed substantially perpendicularly with respect to a direction to allow the first member to approach the second member; and a slanted portion disposed in the vicinity of one of the two planar portions and angled with respect to a direction to allow the first member to approach the second member.

These and other objects, features, and advantages of the present invention will become apparent upon consideration of the following description of the preferred embodiments of the present invention when taken in conjunction with the accompanying drawings.

DETAILED DESCRIPTION

Figure 1:
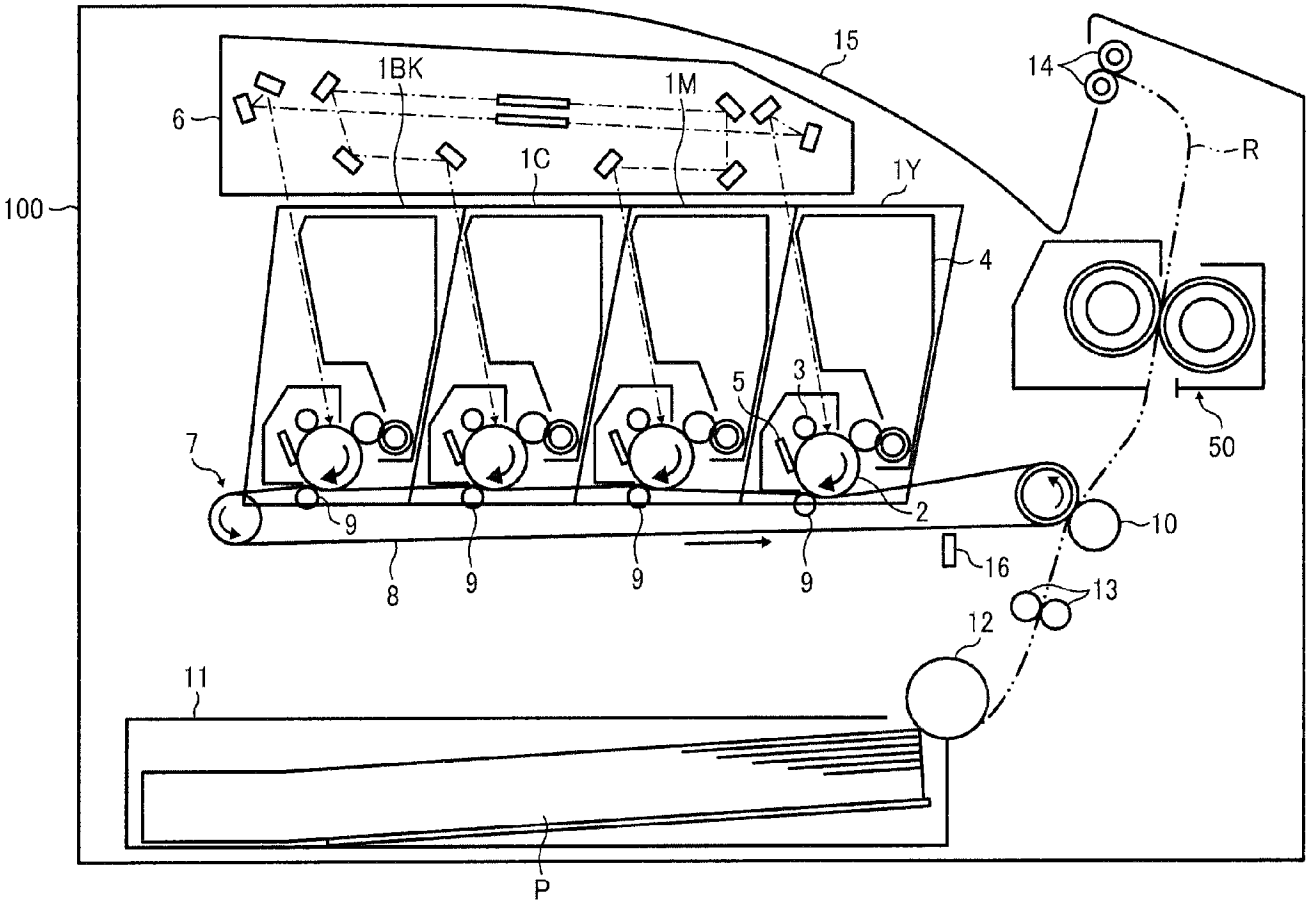
FIG. 1 shows an overall configuration of a color laser printer as an image forming apparatus according to an embodiment of the present invention.

Hereinafter, the present invention will be described referring to the accompanying drawings. In each of the following drawings, parts or components having the same function or shape are given a same reference numeral and once explained, a redundant description thereof will be omitted.

FIG. 1 shows an overall configuration of a color laser printer as an image forming apparatus according to an embodiment of the present invention. First, with reference to FIG. 1, the structure and operation of a color laser printer will be described.

As illustrated in FIG. 1, the image forming apparatus 100 is a color laser printer and includes, in its central part thereof, four image forming units 1Y, 1M, 1C, and 1Bk to form an image of a different color such as yellow (Y), magenta (M), cyan (C), and black (BK) corresponding to decomposed color components of a color image. Each image forming unit 1Y, 1M, 1C, or 1Bk includes a photoreceptor 2 as a latent image carrier; a charging roller 3 as a charger to electrically charge a surface of the photoreceptor 2; a developing device 4 to develop the electrostatic latent image formed on the photoreceptor 2 by supplying toner; and a cleaning blade 5 as a cleaner to clean the surface of the photoreceptor 2. In FIG. 1, reference numerals are given to parts included in the image forming unit 1Y for forming a yellow image, that is, the photoreceptor 2, the charging roller 3, the developing device 4 and the cleaning blade 5 are supplied with a reference numeral, and reference numerals for other parts corresponding to the other image forming units 1M, 1C, and 1Bk are omitted.

In FIG. 1, an exposure unit 6 to form an electrostatic latent image on the surface of the photoreceptor 2 is disposed above each of the image forming units 1Y, 1M, 1C, and 1Bk. The exposure unit 6 includes a light source, a polygonal mirror, an ID lens, a reflection mirror, and the like, and is configured to irradiate each surface of the photoreceptor 2 with laser beams in patterns that are defined by image data.

A transfer device 7 configured to transfer a toner image to a sheet of paper as recording media is disposed below the image forming units 1Y, 1M, 1C, and 1Bk. The transfer device 7 includes an endless intermediate transfer belt 8 as a transfer member; and four primary transfer rollers 9 each as a primary transfer device. The intermediate transfer belt 8 is stretched over a plurality of support rollers with a prescribed tension. One of the support rollers rotates as a drive roller so that the intermediate transfer belt 8 rotates in an arrow direction in FIG. 1.

The four primary transfer rollers 9 each are contacted by the photoreceptor 2 via the intermediate transfer belt 8. With this structure, each photoreceptor 2 and the intermediate transfer belt 8 are contacted against each other and a primary transfer nip at which a toner image is transferred is formed between each photoreceptor 2 and the intermediate transfer belt 8. Each primary transfer roller 9 is connected with a power source, not shown, and is supplied with a predetermined direct current voltage (DC) and/or alternating current voltage (AC).

A secondary transfer roller 10 as a second transfer device is contacted the intermediate transfer belt 8 at a position where another support roller is disposed. With this structure, a secondary transfer nip to transfer a toner image is formed between the secondary transfer roller 10 and the intermediate transfer belt 8. In addition, similarly to the primary transfer rollers 9, the secondary transfer roller 10 is connected with a power source, not shown, and is supplied with a predetermined direct current (DC) voltage and/or alternating current (AC) voltage.

A sheet tray 11 containing a sheet P and a sheet feed roller 12 to convey the sheet P from the sheet tray 11 are disposed in a bottom of the apparatus 100. Herein, the sheet P includes various types of sheets such as a sheet of cardboard, a postcard, an envelope, plain paper, thin paper, coated paper or art paper, tracing paper, and the like. An OHP sheet or film may be used as recording media.

Further, a conveyance path R through which the sheet P is conveyed from the sheet tray 11 to an outside the printer via the secondary transfer nip is defined internally by multiple component parts disposed inside the apparatus 100. In the conveyance path R, a registration roller pair 13 serving as a timing roller is disposed upstream of the secondary transfer nip or the secondary transfer roller 10 in the conveyance path R of the sheet P. A fuser 50 to fuse and fix an unfixed image transferred onto the sheet P is disposed downstream in the sheet conveyance direction from the position of the secondary transfer nip or the secondary transfer roller 10. Further, a pair of sheet discharge rollers 14 to discharge the sheet outside the apparatus body is disposed downstream in the sheet conveyance direction of the conveyance path R. In addition, a sheet discharge tray 15 to stack the sheet discharged outside the apparatus is disposed on an upper surface of the apparatus 100.

Further, a sensor 16 as a pattern detector is disposed at a position opposite a circumferential surface of the intermediate transfer belt 8. In the present embodiment, the sensor 16 is a reflection-type optical sensor, and detects an image pattern formed on the intermediate transfer belt 8 for detecting a density of an image or a positional shift of an image.

Next, with reference to FIG. 1, basic operation of the printer according to an embodiment of the present invention will be described.

When an image forming operation is started, each photoreceptor 2 of each of the image forming units 1Y, 1M, 1C, and 1Bk is driven by a driving device, not shown, to rotate in a clockwise direction as illustrated in FIG. 1, and each surface of the photoreceptor 2 is uniformly charged at a predetermined polarity by the charging roller 3. Based on the image data of the document read by the image reader, not shown, the exposure unit 6 irradiates the charged surface of each photoreceptor 2 with laser beams to form an electrostatic latent image on the surface of each photoreceptor 2. In this case, the image data exposed on each photoreceptor 2 is monochrome image data decomposed, from the target full-color image, into color data of yellow, magenta, cyan, and black. Each developing device 4 supplies toner to the electrostatic latent image formed on the photoreceptor 2, and the electrostatic latent image is visualized by rendering it visible as a toner image.

When the image forming operation is started, the intermediate transfer belt 8 is driven to rotate in the direction indicated by an arrow in the figure. Further, a constant voltage or constant-current controlled voltage having an opposite polarity to the polarity of the charged toner is applied to each primary transfer roller 9. Accordingly, a transfer electric field is formed at a primary transfer nip.

Thereafter, upon the toner image of each color formed on the photoreceptor 2 reaching the primary transfer nip associated with the rotation of each photoreceptor 2, the toner image of each color formed on each photoreceptor 2 is sequentially transferred in a superposed manner on the intermediate transfer belt 2 by the transfer electric field formed in the primary transfer nip. Thus, a full-color toner image is carried on the surface of the intermediate transfer belt 8. In addition, the toner which has not been transferred to the intermediate transfer belt 8 and remaining on each photoreceptor 2 is removed by the cleaning blade 5.

The sheet feed roller 12 is started to rotate so that the sheet P is sent out from the sheet tray 11 to the conveyance path R. The sheet P fed out to the conveyance path R is sent to the secondary transfer nip at a timing defined by a pair of registration rollers 13. In this case, because the transfer voltage having a polarity opposite that of the charged toner of the toner image on the intermediate transfer belt 8 is applied to the secondary transfer roller 10, a transfer electric field is formed at the secondary transfer nip.

Thereafter, upon the toner image formed on the intermediate transfer belt 8 reaching the secondary transfer nip associated with the rotation of the intermediate transfer belt 8, the toner image on the intermediate transfer belt 8 is transferred en bloc to the sheet P via the transfer electric field generated in the secondary transfer nip.

Then, the sheet P is conveyed to the fixing device 50 and the toner image on the sheet P is fixed onto the sheet P. The sheet P is then discharged outside the apparatus by the sheet discharge rollers 14 and is stacked on the sheet discharge tray 15.

The explanation heretofore relates to an image forming operation when a full-color image is formed on the sheet; however, a monochrome image may be formed using any one of the four image forming units 1Y, 1M, 1C, and 1Bk and an image formed of two or three colors may be possible by using two or three image forming units.

When correcting a density of each colored image or a positional shift of an image, the image-forming units 1Y, 1M, 1C, and 1Bk form an image pattern for a detection purpose on the surface of the intermediate transfer belt 8. Specifically, in the basically similar manner as in the image forming operation and the image transferring operation, the image pattern for detecting the image density or the image positional shift is formed on each photoreceptor 2 of the image forming units 1Y, 1M, 1C, and 1Bk and the image pattern formed on each photoreceptor 2 is transferred to the intermediate transfer belt 8 at a position of the primary transfer nip. When the image pattern reaches a position opposite the sensor 16 according to the rotation of the intermediate transfer belt 8, the sensor 16 detects the image pattern. Based on the detection result, the density or the positional shift of the image is corrected.

Figure 2:
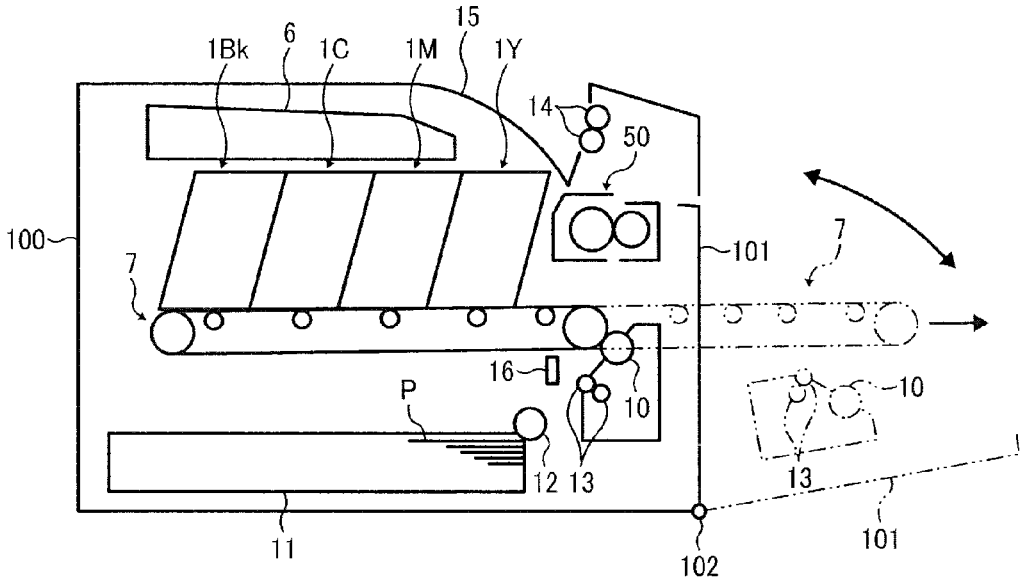
FIG. 2 is a view illustrating how to detach a transfer device from the image forming apparatus shown in FIG. 1.

FIG. 2 is a view illustrating how to detach the transfer device 7 from the apparatus 100.

As illustrated in FIG. 2, the transfer device 7 is configured to move in the horizontal direction. In addition, a cover 101 disposed on a front portion of the apparatus 100 (right side in FIG. 2) oscillates about a hinge 102 so that the cover 101 is openable with respect to the apparatus 100. When the cover 101 is opened, the secondary transfer roller 10 and the pair of registration rollers 13 are also retracted from the front of the transfer device 7 along with the cover 101. In this state, the transfer device 7 is moved in the horizontal direction and is detached from the apparatus 100.

However, the sensor 16 is not detached along with the transfer device 7 and is left as is in the apparatus 100 when the transfer device 7 is removed. The sensor 16 is constructed to be separable from the transfer device 7 so as not to contact the transfer device 7 when the transfer device 7 is removed.

Hereinafter, contact and separation device of the sensor 16 will now be described.

Figure 3:
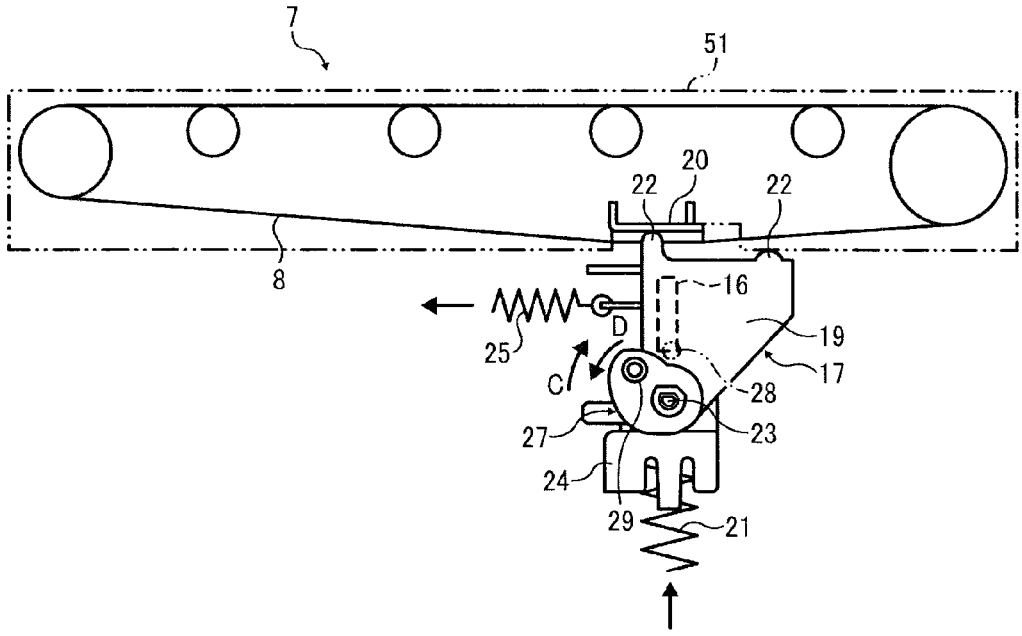
FIG. 3 is a side view of the transfer device and a sensor separation device.
Figure 4:
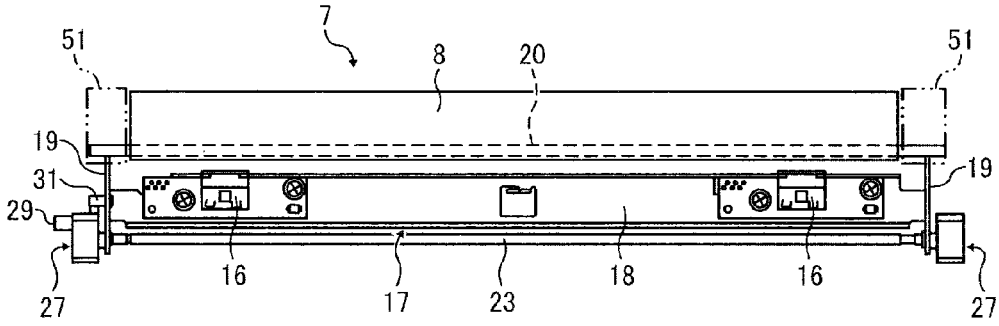
FIG. 4 is a front view of the transfer device and the sensor separation device.
Figure 5:
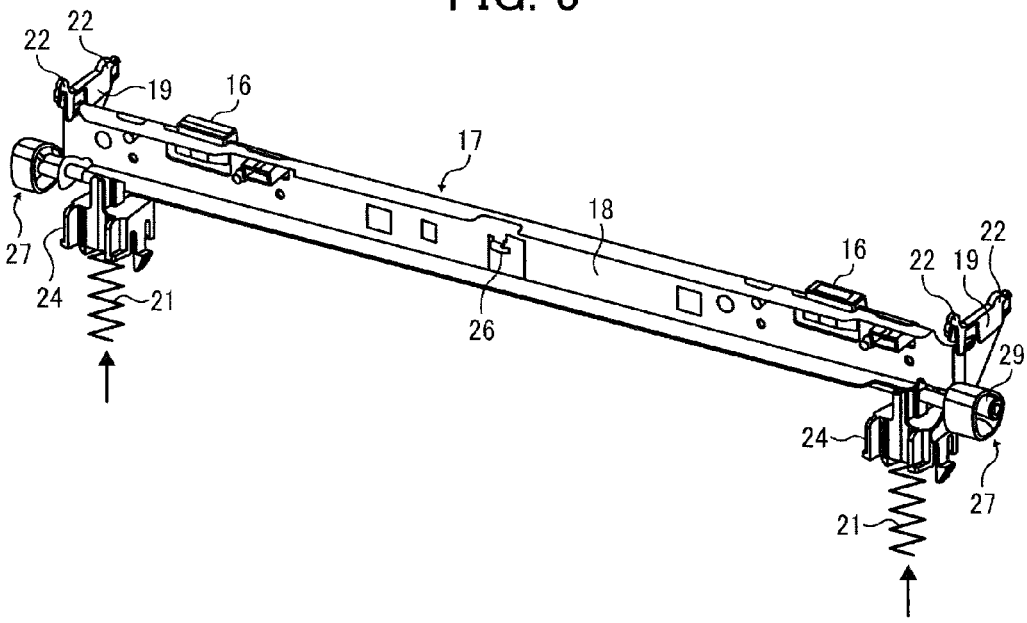
FIG. 5 is an oblique view of the sensor separation device seen from the rear.
Figure 6:
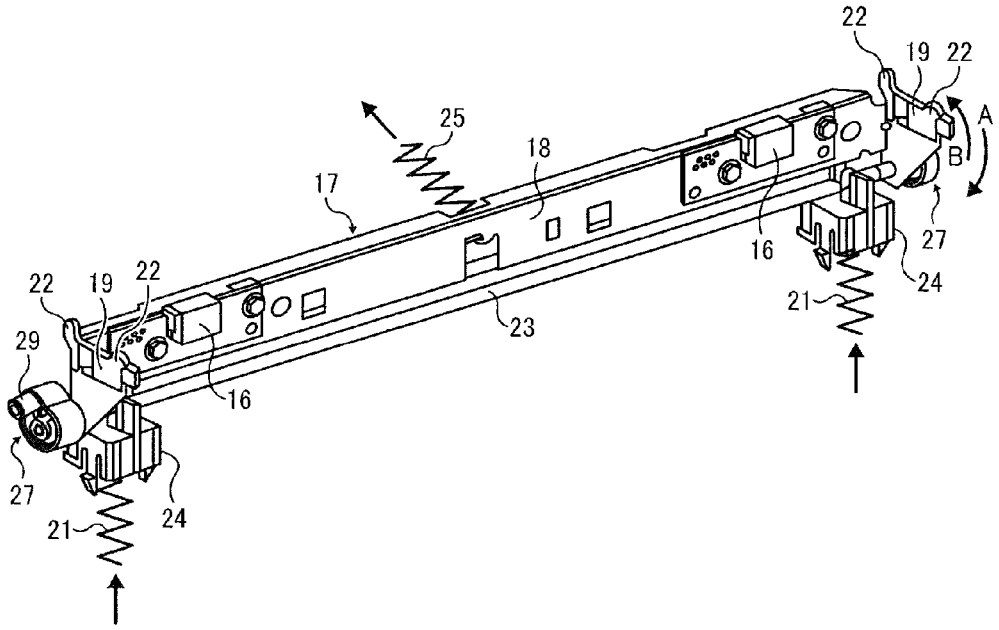
FIG. 6 is an oblique view of the sensor separation device seen from the front.

FIG. 3 is a side view of the transfer device and the sensor separation device; FIG. 4 is a front view of FIG. 3; FIG. 5 is an oblique view of the sensor separation device seen from the rear; and FIG. 6 is an oblique view of the sensor separation device seen from the front. FIGS. 3 and 4 show a state in which the transfer device is attached to the apparatus body and the sensor is positioned relative to the thus-attached transfer device.

As illustrated in FIG. 3, in the present embodiment of the invention, the sensor separation device to allow the sensor to contact with and separate from the transfer device 7 includes a compression spring 21 to bias the sensor 16 to approach the intermediate transfer belt 8; a cam follower 28 fixed to a member other than the sensor 16 is fixed to, such as the apparatus 100; and a cam 27 to slidably contact the cam follower 28 so as to move the sensor 16 in a direction separating from the intermediate transfer belt 8 against a biasing force of the compression spring 21.

Specifically, the sensor 16 is held by a support member or a first supporter 17 and the compression spring 21 biases the support member 17 against the intermediate transfer belt 8. Further, the cam 27 is rotatably disposed with respect to the support member 17 via a support shaft 23 which is disposed in a horizontal direction. When the cam 27 rotates about the support shaft 23, the cam 27 slidably contacts the cam follower 28 to move the support member 17 downward as in FIG. 3 against the biasing force of the compression spring 21 so that the sensor 16 is separated from the intermediate transfer belt 8.

As illustrated in FIG. 4, the support member 17 includes a sensor fitting 18 extending in the width direction of the intermediate transfer belt 8; and a pair of side plates 19 disposed at both ends in the longitudinal direction of the sensor fitting 18. In the present embodiment, two sensors 16 are disposed on the sensor fitting 18.

As illustrated in FIG. 3, a belt retention member or a second supporter 20 to support an inner peripheral surface of the intermediate transfer belt 8, i.e., a surface opposite the opposed surface of the sensor 16, is disposed at a position relative to the intermediate transfer belt 8 opposed to the sensor 16. The belt retention member 20 is fixed to a pair of frame members 51 included in the transfer device 7. The support rollers supporting the primary transfer roller 9 and the intermediate transfer belt 8 are rotatably attached to the pair of frame members 51.

As illustrated in FIG. 4, the belt retention member 20 extends in the width direction of the intermediate transfer belt 8 and both ends thereof protrude beyond both lateral edges of the intermediate transfer belt 8. The pair of side plates 19 contacts both ends of the belt retention member 20 protruding outwards and the pair of frame members 51, thereby positioning the sensor 16 relative to the intermediate transfer belt 8. Specifically, because the support member 17 is pressed toward the belt retention member 20 by the compression spring 21 (see FIG. 3), two convex parts 22 formed on upper portions of the side plates 19 contact bottom surfaces of the belt retention member 20 and the frame members 51 so that the sensor 16 is positioned relative to the intermediate transfer belt 8.

Further, when there is a space to provide a biasing member above the support member 17, a tension spring may be used instead of the compression spring. Specifically, one end of the tension spring is attached to the support member 17 and the other end is attached to the apparatus 100, so that the support member 17 is similarly pressed against the belt retention member 20.

As illustrated in FIG. 4, the support member 17 is rotatably supported by the support shaft 23 as a supporting member. Both ends of the support shaft 23 are inserted into each through-hole formed on the pair of side plates 19 of the support member 17. Accordingly, the support shaft 23 and the support member 17 are relatively rotatable.

Further, as illustrated in FIG. 6, receivers 24 to receive the compression spring 21 are formed at both ends of the support shaft 23. The receivers 24 are relatively rotatably attached to the support shaft 23 and, even when the support shaft 23 rotates, the receivers 24 do not rotate, so that the biasing force of the compression spring 21 is stably given to the receivers 24.

Further, each receiver 24 is so constructed as to move along a guide member, not shown, which is disposed on the apparatus 100. The guide member extends in a direction crossing the surface of the intermediate transfer belt 8 to which the sensor 16 is opposed. Because the receiver 24 moves along the guide member, the support member 17 is stably guided in a direction approaching or separating from the intermediate transfer belt 8.

In addition, a biasing member, which, in the present embodiment, is a tension spring 25, is provided to a rear side of the support member 17 as illustrated in FIGS. 3 and 6. One end of the tension spring 25 is attached to hang on a retainer 26 (see FIG. 5) disposed on a longitudinal center of the backside of the sensor fitting 18 and the other end of the tension spring 25 is hung on a retainer, not shown, disposed on the apparatus 100. The support member 17 is biased backwards by the tension spring 25 so that a force to return to an original position by rotating in an arrow B direction in FIG. 6 is given to the support member 17 when the support member 17 rotates in an arrow A direction in FIG. 6 and is slanted toward a front side.

Alternatively, instead of the tension spring 25, a compression spring may be used to press the support member 17 in the same direction as above. Further, the receiver 24 is provided with a regulator, not shown, configured to restrict the support member 17 to retain a predetermined posture against the biasing force of the tension spring 25 when the support member 17 is returned to an original position by the tension spring 25.

As illustrated in FIG. 5, a cam 27 is disposed at both ends of the support shaft 23. A D-shaped recess is formed in the cam 27 and the end of the support shaft 23 is similarly shaped.

The support shaft 23 and the cam 27 are engaged with each other, and then, both parts integrally rotate.

In the present embodiment, the cam 27 and the cam follower 28 are disposed at both ends of the support shaft 23, respectively, so that the evacuating operation of the sensor 16 can be performed more stably than a case in which the cam 27 and the cam follower 28 are disposed on only one end of the support shaft 23. In addition, in the present embodiment, the cam 27 and the support member 17 are connected via the support shaft 23, and each of the cams 27 and the support member 17 is rotated about the support shaft 23. Accordingly, the same rotary shaft is used for the cam 27 and the support member 17, for a more compact layout Further, the cam 27 rotates according to opening and closing of the cover 101. In the present embodiment, as illustrated in FIG. 5, a convex joint 29 is disposed at one of the cams 27 and the joint 29 is connected with a link member, not shown, working with the opening and closing of the cover 101. As described above, because the two cams 27 are connected integrally via the support shaft 23, when one of the cams 27 rotates linking with the link member, the other cam 27 also rotates. In this case, the cam 27 rotates from a state as illustrated in FIG. 3 to an arrow C direction when the cover 101 is opened, and the cam 27 rotates in an arrow D direction in FIG. 3 when the cover 101 is closed. In the present embodiment, the joint 29 is disposed at one of the two cams 27; however, the joint 29 may be disposed at both of the cams 27 so that both cams 27 are allowed to rotate in accordance with the opening and closing of the cover 101.

Figure 7:
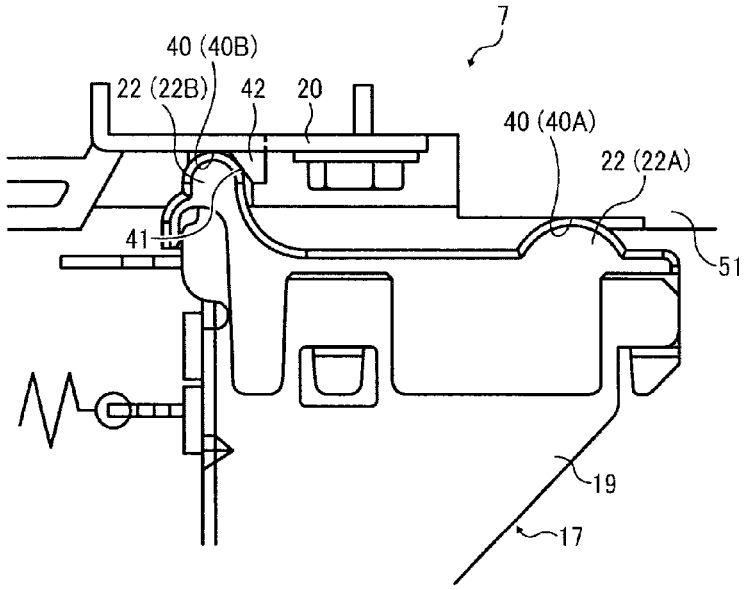
FIG. 7 is an enlarged view of a sensor positioning device.

FIG. 7 is an enlarged view of a positioning device of the sensor 16.

As illustrated in FIG. 7, two planar portions 40 and a slanted portion 41 are disposed at a side of the transfer device 7 as positioning portions for the support member 17. The two planar portions 40 each are disposed substantially perpendicularly with respect to a direction to allow the sensor 16 to approach the intermediate transfer belt 8. On the other hand, the slanted portion 41 is disposed at an angle to a direction to allow the sensor 16 to approach the intermediate transfer belt 8.

In addition, the two planar portions 40 are disposed apart from each other so as to correspond to two contact portions 22, respectively. Hereinafter, for convenience, the planar portion 40 on the right in FIG. 7 is defined as a first planar portion 40A and the planar portion 40 on the left is defined as a second planar portion 40B. In the present embodiment, the slanted portion 41 is disposed in the vicinity of the second planar portion 40B. In particular, the slanted portion 41 is disposed at a position nearer to the second planar portion 40B than to the first planar portion 40A.

Figure 8:
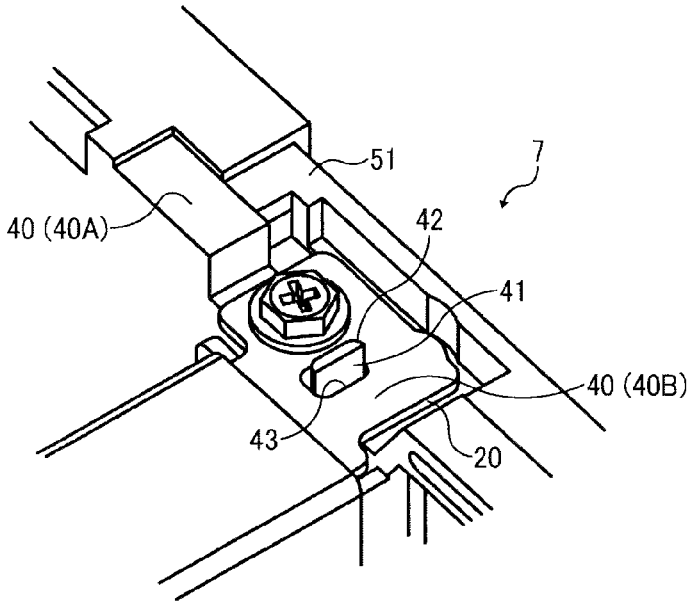
FIG. 8 is a view of the transfer device seen from the bottom.

In the present embodiment, the first planar portion 40A is provided to the frame member 51 and the second planar portion 40B is provided to the belt retention member 20. Further, the slanted portion 41 is formed on a projection 42 disposed on the frame members 51. As illustrated in FIG. 8, the projection 42 is constructed to protrude from an opening 43 formed on the belt retention member 20.

As described above, in the present embodiment, the two planar portions 40A, 40B are disposed on a different part from a part on which the slanted portion 41 is disposed. However, alternatively, all these members may be disposed on a same part. When all the members are disposed on the same part, an accumulated precision error is reduced, thereby improving the precision in the positioning. Further, when the two planar portions 40A, 40B are disposed on the same planar surface formed of the same material, the precision in the positioning is further improved.

The two contact portions 22 are disposed apart from each other in the direction crossing the rotary axis, i.e., the support shaft 23 of the support member 17 as illustrated in FIG. 7. Hereinafter, for convenience, the contact portion 22 at a side corresponding to the first planar portion 40A is referred to as a first contact portion 22A and the contact portion 22 at a side corresponding to the second planar portion 40B is referred to as a second contact portion 22B. Each contact portion 22A, 22B includes a circular arc leading end. In the present embodiment, the first contact portion 22A includes a circular arc with a diameter greater than that of the circular arc of the second contact portion 22B. Further, both contact portions 22A, 22B are preferably formed of any material having a slidable property.

Figure 9:
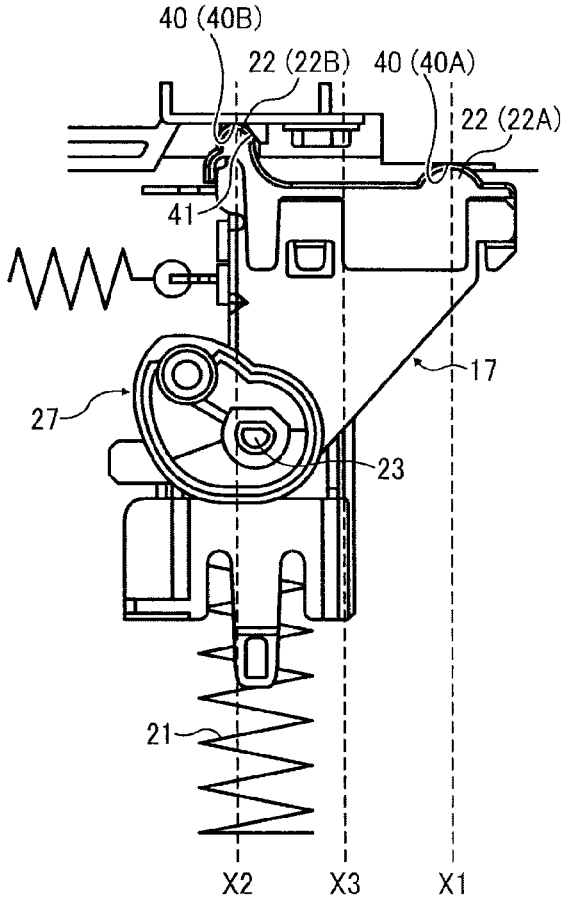
FIG. 9 is a view illustrating relative positions of a contact portion and a compression spring.

In FIG. 9, a broken line X1 shows a vertical line passing though the first contact portion 22A, and a broken line X2 shows a vertical line passing through the second contact portion 22B. A broken line X3 is a vertical line passing through a center position between the broken lines X1 and X2. As illustrated in FIG. 9, the compression spring 21 is disposed nearer to the broken line X2 passing through the second contact portion 22B than to the broken line X3 passing through the center position between the broken lines X1 and X2. In other words, the compression spring 21 is disposed at the side of the second contact portion 22B disposed in the vicinity of the slanted portion 41. Similarly, in the present embodiment, the support shaft 23 is disposed at the side of the second contact portion 22B.

Next, referring to FIG. 10, a contact and separation of the sensor 16 with respect to the transfer device 7 will be described.

Figure 10A:
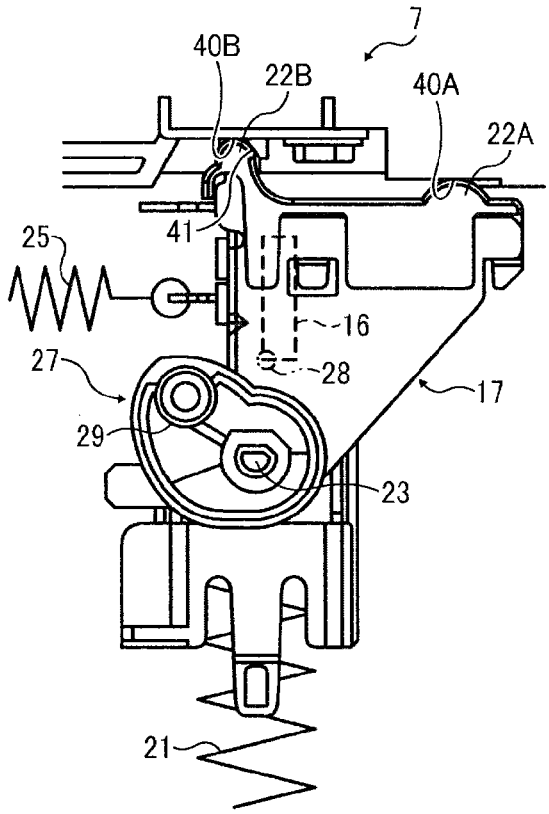
FIGS. 10A and 10B each are views illustrating a separation operation of the sensor.

In a state as illustrated in FIG. 10A, the contact portions 22A, 22B of the support member 17 contact the planar portions 40A, 40B and the slanted portion 41. Accordingly, the sensor 16 is disposed close to the transfer device 7. Specifically, the sensor 16 is positioned where the image pattern formed on the intermediate transfer belt 8 can be detected. In addition, in the state as illustrated in FIG. 10A, the cover 101 is closed.

When the cover 101 is rotated to be opened in a replacement of the transfer device 7 from the state in which the cover 101 is closed, the cam 27 rotates in the clockwise direction and slidably contacts the cam follower 28 associated with opening of the cover 101. As a result, a distance between the rotary axis of the cam 27 and the cam follower 28 is extended against the biasing force of the compression spring 21. With this movement, as illustrated in FIG. 10B, the support member 17 is pushed down and the sensor 16 is moved to a retracted position in a substantially perpendicular direction relative to the surface of the intermediate transfer belt 8 and separated therefrom.

Next, an operation when the cover 101 is being closed will be described.

Figure 10B:
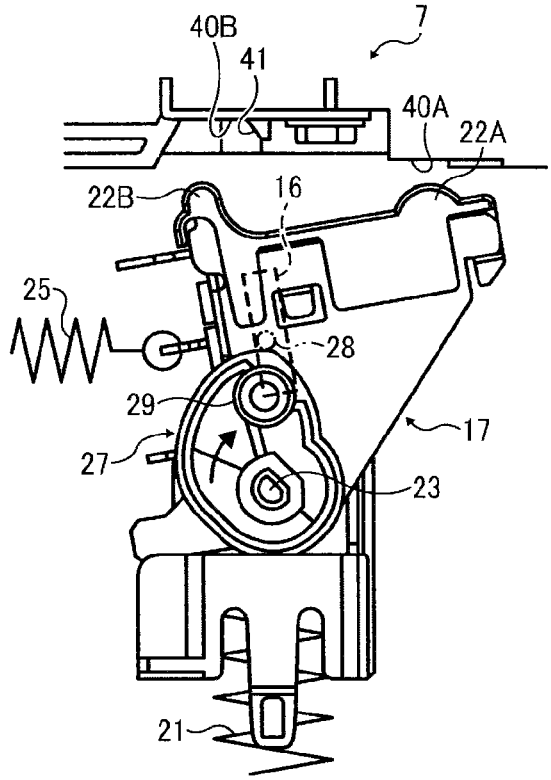

When the cover 101 is rotated to be closed after the transfer device 7 has been replaced, the cam 27 rotates in the counterclockwise direction from the state as illustrated in FIG. 10B and slidably contacts the cam follower 28. As a result, the distance between the rotary axis of the cam 27 and the cam follower 28 is narrowed due to the stretching force of the compression spring 21 contrary to the opening operation of the cover 101. As a result, the support member 17 is pushed up and the contact portions 22A, 22B of the support member 17 contact the planar portions 40A, 40B and the slanted portion 41 so that the sensor 16 is positioned at the detection position as illustrated in FIG. 10A.

As described above, in the present embodiment, the sensor 16 can be moved from the detection position close to the transfer device 7 to the retracted position apart from the transfer device 7 when the cover 101 is opened. With this construction, when the transfer device 7 is attached or removed, the transfer device 7 is prevented from contacting the sensor 16, thereby suppressing flaws and damage in the subject part due to contact between both parts.

In addition, in the present embodiment, because the sensor 16 can be moved between the detection position and the retracted position in accordance with the opening and closing of the cover 101, any dedicated part for moving the sensor 16 need not be provided additionally. With this structure, an uncomplicated, compact, and low-cost positioning device can be realized. In addition, when the cover 101 is open, the sensor 16 is automatically retracted relative to the transfer device 7. Accordingly, no retracting operation of the sensor 16 is necessary when the transfer device 7 is to be replaced. Accordingly, flaws and damage to the part in the replacement of the transfer device 7 can be securely prevented.

In addition, a device to move the sensor 16 may be implemented with a member other than the cover 101. For example, a control lever switchable between a first position and a second position may be provided, and a pattern detector is positioned at the detection position when the control lever is switched to the first position and is positioned at the retracted position when the control lever is switched to the second position.

FIGS. 11A to 11D show variations in the positioning when the support member 17 is positioned relative to the transfer device 7.

Figure 11A:
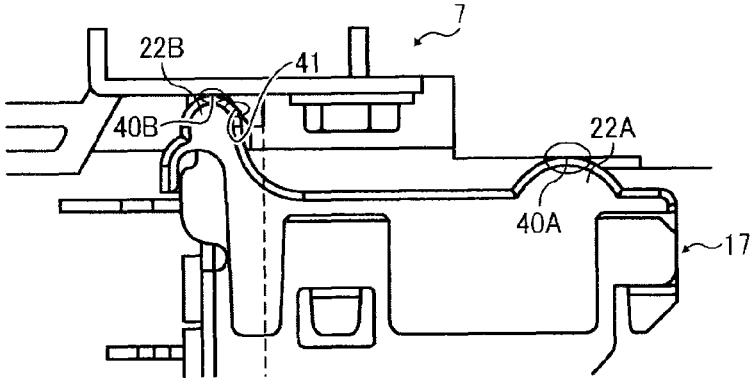
FIGS. 11A to 11D each show variations of positioning when a support member is positioned relative to the transfer device.

FIG. 11A shows an optimal positioning state in which the support member 17 is positioned without any misalignment caused by tolerances or assembly errors of the parts or components. In this case, the support member 17 contacts the transfer device 7 at three points as illustrated by circles in FIG. 11A. Specifically, the first contact portion 22A contacts the first planar portion 40A and the second contact portion 22B contacts both of the second planar portion 40B and the slanted portion 41.

Figure 11B:
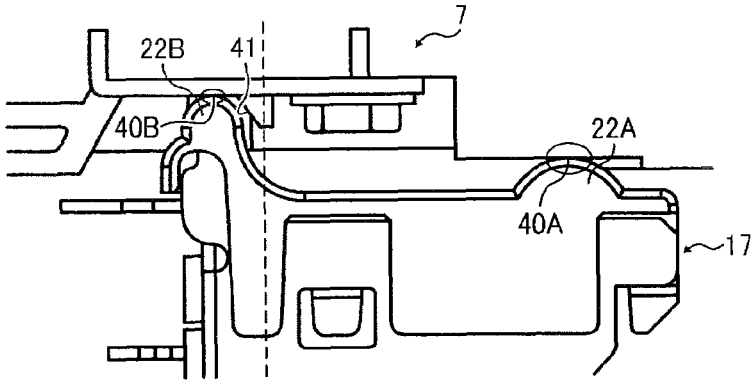
Figure 11C:
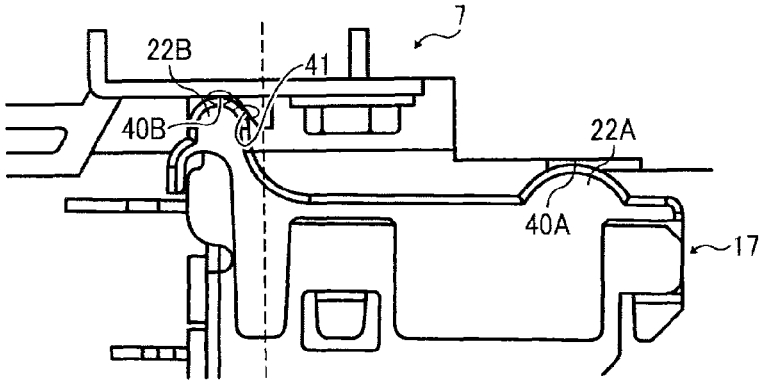
Figure 11D:
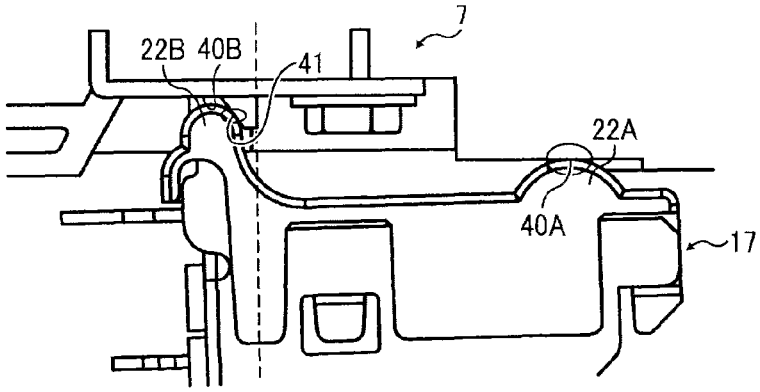

On the other hand, FIGS. 11B to 11D each show positioning states when the misalignment occurs due to tolerances of the parts, or the like. In this case, the support member 17 contacts either two points among three positioning points including the planar portions 40A, 40B and the slanted portion 41. (Circles in each figure show contact points.)

Figure 12:
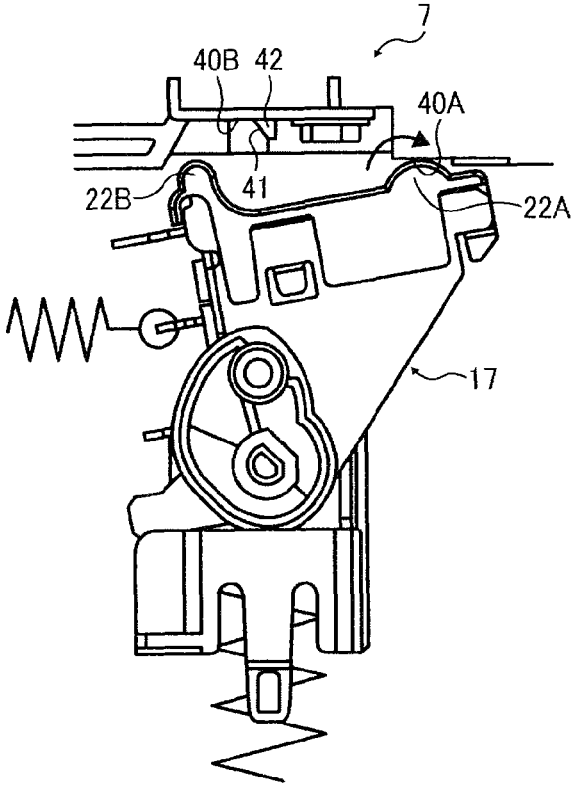
FIG. 12 shows a state in which a first contact portion contacts the transfer device before a second contact portion does.
Figure 13:
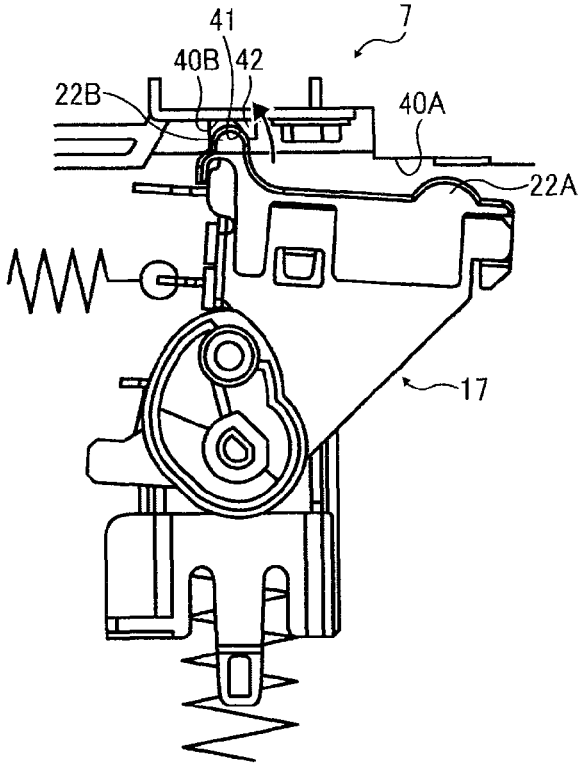
FIG. 13 shows a state in which the second contact portion contacts the transfer device before the first contact portion does.

FIGS. 12 and 13 show how the support member 17 contacts the transfer device 7.

Specifically, FIG. 12 shows a state in which the first contact portion 22A contacts the transfer device 7 before the second contact portion 22B does. In this case, when the first contact portion 22A contacts the first planar portion 40A previously, the support member 17 rotates clockwise using the contact point as a reference position. Then, the second contact portion 22B contacts either or both of the second planar portion 40B and the slanted portion 41.

On the other hand, contrary to the above, FIG. 13 shows a case in which the second contact portion 22B contacts the transfer device 7 before the first contact portion 22A does. In this case, when the second contact portion 22B contacts the slanted portion 41, the second contact portion 22B slides on the slanted portion 41 and the second contact portion 22B contacts the second contact portion 22B, or alternatively, the first contact portion 22A contacts the first planar portion 40A and is positioned. Further alternatively, each contact portion 22A, 22B contacts the planar portions 40A, 40B, respectively, and is positioned.

Configured as above, in the present embodiment, even when one of the contact portions 22A, 22B contacts the transfer device 7 before the other contact portion does, the support member 17 can still be positioned precisely by contacting at least two of the three positioning points.

If for instance, the positioning portions do not include the slanted portion 41 and include only the planar portions 40A, 40B, when a misalignment occurs due to tolerances of any parts, it may occur that the support member 17 is held contacting either one of the two planar portions 40*a*, 40*b*.

Specifically, in the structure lacking in the slanted portion 41, suppose that the compression spring 21 biasing the support member 17 to the side of the transfer device 7 is disposed below the second contact portion 22B. In this case, when the second contact portion 22B contacts the second planar portion 40B previously, the support member 17 is balanced as is, and the first contact portion 22A may not contact the first planar portion 40A. In this case, in order to contact the first contact portion 22A to the first planar portion 40A, it is required that the compression spring 21 is disposed below the center position between both contact portions 22A, 22B (along the line X3 in FIG. 9) and that the support member 17 is allowed to rotate based on the contact position of the second contact portion 22B with the second planar portion 40B set as a reference position.

However, mounting the compression spring 21 below the center position between both contact portions 22A, 22B should be an obstacle for a free layout of parts. Further, the distance between both contact portions 22A, 22B and the compression spring 21, i.e., the lateral distance in FIG. 9 in particular, greatly increases, which is not suitable for achieving a compact structure for the support member 17.

Advantageously, in the present embodiment, even though the compression spring 21 is disposed below the second contact portion 22B, the second contact portion 22B contacts the slanted portion 41 and the support member 17 is allowed to rotate easily using the contact position of the second contact portion 22B as a reference position. With this configuration, even when the misalignment occurs due to the tolerances of any parts, the sensor 16 can be accurately positioned with respect to the intermediate transfer belt 8, so that the inclination of the sensor 16 with respect to the surface of the intermediate transfer belt 8 is optimized. In addition, the compression spring 21 can be disposed below the second contact portion 22B, which is advantageous for the layout of the parts, saving space and achieving a more compact configuration.

As illustrated in FIG. 13, when the second contact portion 22B contacts the transfer device 7 prior to the first contact portion 22A, it may occur that the second contact portion 22B does not contact the slanted portion 41 and rides on a tip surface of the projection 42, and is held as is due to relative positions of the transfer device 7 and the support member 17 and a reaction against the biasing force of the compression spring 21. To prevent this, it is preferable to make the slanted portion 41 longer and extend a contactable range of the second contact portion 22B with respect to the slanted portion 41. If constructed as above, the projection 42 is forced to be large, leading to interference between the projection 42 and the support member 17 when the transfer device 7 is to be replaced. To circumvent this problem, the evacuation amount of the support member 17 relative to the transfer device 7 needs to be large, which may cause the entire apparatus to be large.

As a result, contacting the support member 17 to the transfer device 7 is preferably configured such that the first contact portion 22A contacts the transfer device 7 prior to the second contact portion 22B as illustrated in FIG. 12. If the contact between the support member 17 and the transfer device 7 is configured as above, the second contact portion 22B does not ride or rarely rides on the tip surface of the projection 42. Then, it is not necessary to extend the slanted portion 41 and the entire apparatus is prevented from becoming large.

In addition, the tip portion of the slanted portion 41 or the projection 42 is preferably disposed inside the exterior of the transfer device 7 or at the same level of the exterior of the transfer device 7. As configured above, in the replacement of the transfer device 7, the tip portion of the slanted portion 41 does not interfere with the frame of the apparatus 100 so that the retracting part does not need to be provided to the apparatus 100.

Figure 14:
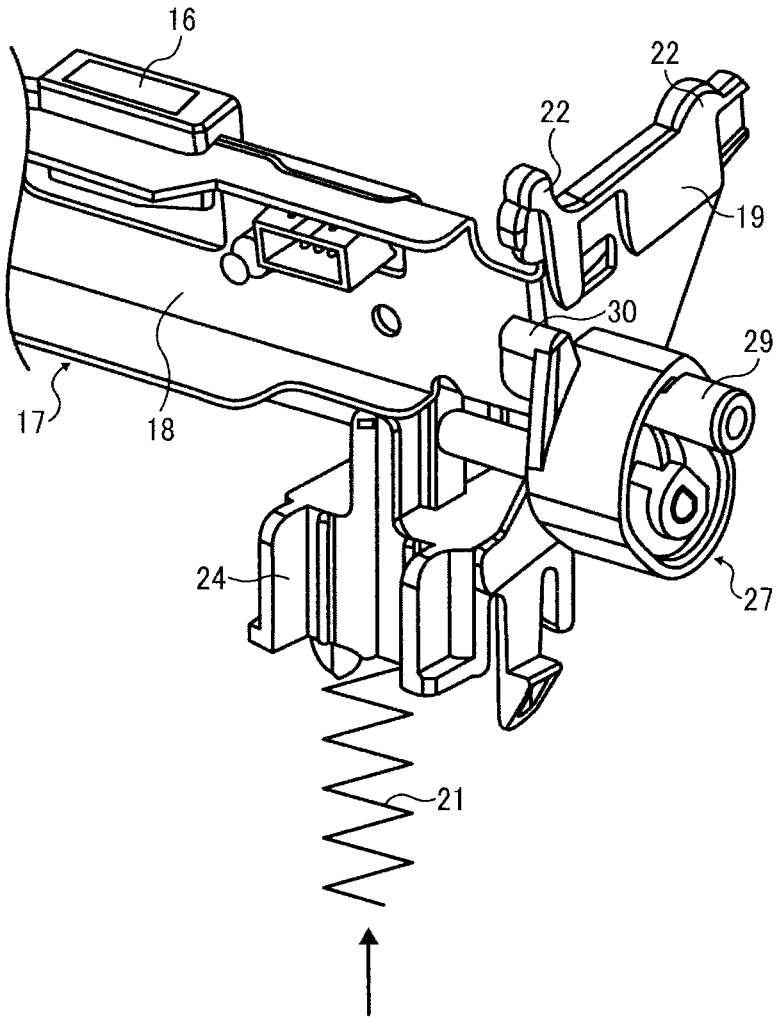
FIG. 14 is a view illustrating another embodiment of the present invention.

FIG. 14 is a view illustrating another embodiment of the present invention.

In the embodiment as illustrated in FIG. 14, a convex joint 30 is integrally formed with the cam 27. When the convex joint 30 rotates along with the cam 27, the convex joint 30 contacts a rear side of the support member 17. In the present embodiment, the convex joint 30 is disposed at one of the two cams 27; however, the convex joint 30 may be disposed at both of the cams 27.

Next, referring to FIG. 15, a contact and separation of the sensor 16 with respect to the transfer device 7 will be described.

Figure 15A:
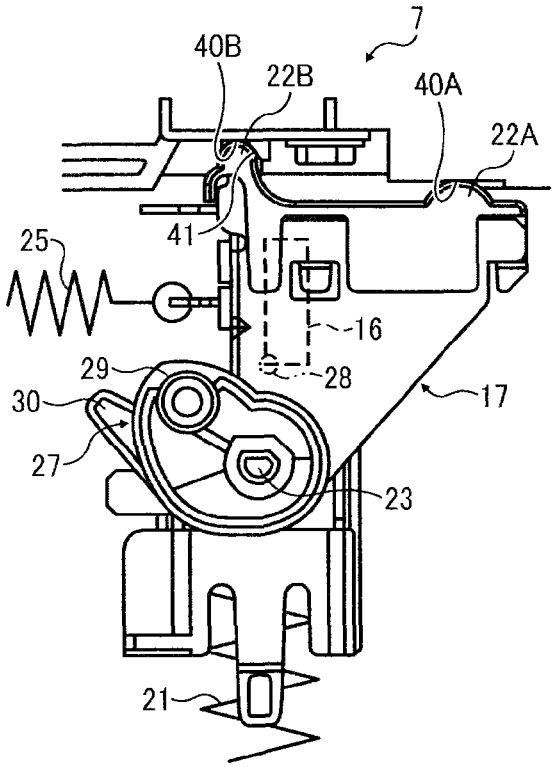
FIGS. 15A to 15C are views illustrating a separation operation of the sensor in the embodiment of FIG. 14.

In a state as illustrated in FIG. 15A, the contact portions 22A, 22B of the support member 17 contact the planar portions 40A, 40B and the slanted portion 41 and the sensor 16 is disposed close to the transfer device 7. In addition, in the state as illustrated in FIG. 15A, the cover 101 is closed.

Figure 15B:
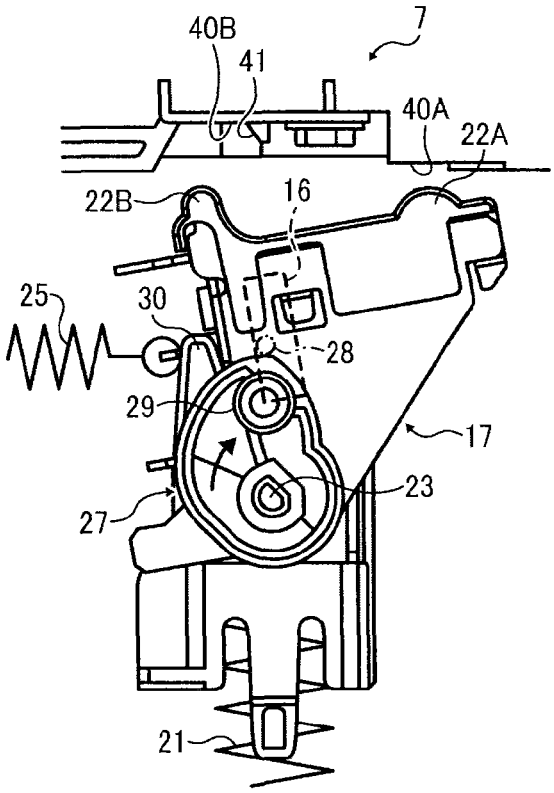

When the cover 101 is rotated to be opened in the replacement of the transfer device 7 from a state in which the cover 101 is closed, the cam 27 rotates in the clockwise direction as illustrated in FIG. 15B and slidably contacts the cam follower 28 along with opening of the cover 101.

Because the cam 27 slidably contacts the cam follower 28, first, the distance between the rotary axis of the cam 27 and the cam follower 28 extends against the biasing force of the compression spring 21. With this movement, as illustrated in FIG. 15B, the support member 17 is pushed down and the sensor 16 is moved to a first retracted position separating in a substantially perpendicular direction relative to the surface of the intermediate transfer belt 8.

Figure 15C:
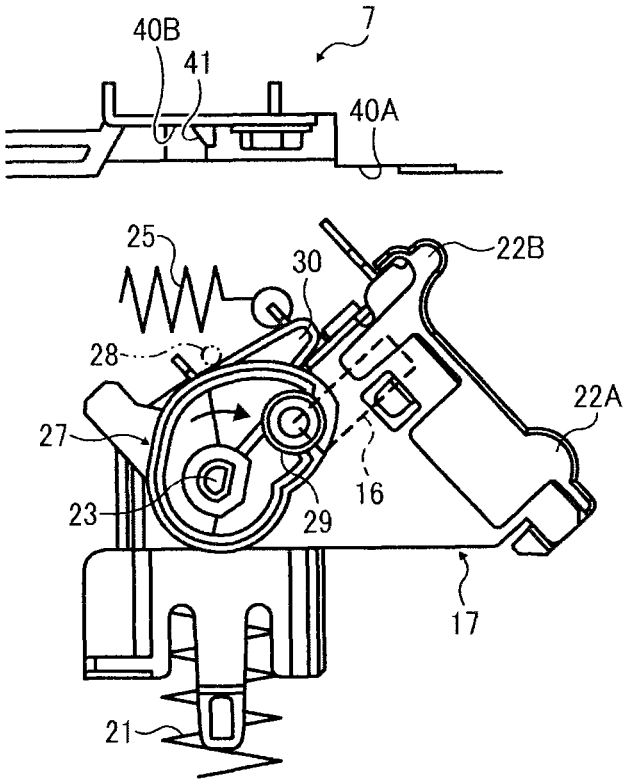

Next, as illustrated in FIG. 15C, the convex joint 30 contacts the rear side of the support member 17 associated with a rotation of the cam 27 and pushes the support member 17 to rotate. As a result, the support member 17 rotates about the support shaft 23 in the clockwise direction and is held in a state slanting toward front, in which the sensor 16 is disposed at a second retracted position.

When the cover 101 is rotated to be closed after the replacement of the transfer device 7, the cam 27 rotates in the counterclockwise direction, i.e., in a direction opposite the rotation direction when the cover 101 is opened, from the state as illustrated in FIG. 15C. In addition, along with the rotation of the cam 27, the convex joint 30 also rotates in the counterclockwise direction. As a result, because the convex joint 30 rotates so as not to press the support member 17, the support member 17 rotates counterclockwise about the support shaft 23 due to the tension force of the tension spring 25 and returns to the state as illustrated in FIG. 15B.

If the cam 27 rotates counterclockwise from the state as illustrated in FIG. 15B, the cam 27 slidably contacts the cam follower 28 such that the distance between the rotary center of the cam 27 and the cam follower 28 is gradually reduced contrary to the state in opening the cover 101. Then, the distance between the rotary center of the cam 27 and the cam follower 28 is narrowed. As a result, the support member 17 is pushed up and the contact portions 22A, 22B of the support member 17 contact the planar portions 40A, 40B and the slanted portion 41 so that the sensor 16 is positioned at the detection position as illustrated in FIG. 15A.

Figure 16:
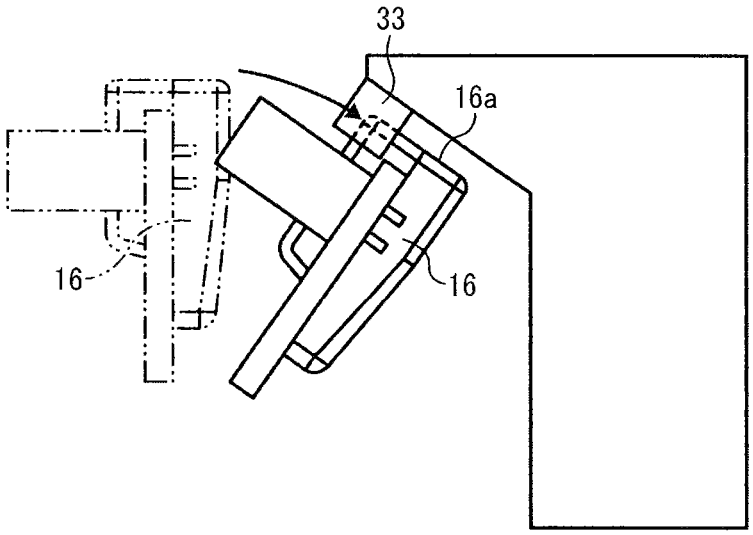
FIG. 16 is a view illustrating another embodiment of the present invention including a cleaner.

As described above, the embodiment as illustrated in FIG. 14 employs a contact/separation device to move the sensor 16 in the substantially perpendicular direction relative to the intermediate transfer belt and to move the sensor 16 in the rotation direction in combination. The embodiment as illustrated in FIG. 16 employs a contact/separation device to only move in the substantially vertical direction. Either way may be employed appropriately in accordance with the layout around the transfer device 7.

In addition, when the support member 17 is rotated and retracted so as to slant toward the front, a cleaning member 33 may be disposed at a moving location of the sensor 16 as illustrated in FIG. 16. In this case, the sensor 16 is allowed to be moved to a cleaning position to be cleaned by the cleaning member 33 simultaneously when moved from the detection position to the retracted position. The cleaning member 33 is formed of a sponge or brush having elasticity and flexibility. When a detection surface 16*a* of the sensor 16 contacts the cleaning member 33 following the rotation of the support member 17, smears of the detection surface 16*a* are removed and cleaned by the cleaning member 33.

The cleaning member 33 that contacts the detection surface of the sensor 16 is preferably formed of a material to charge the detection surface 16*a* at a same polarity with the polarity of the charged toner. With this configuration, the detection surface 16*a* after being cleaned can generate a repulsive force against the toner, thereby preventing the toner from depositing on the detection surface 16*a* and the detection surface 16*a* from being contaminated with toner.

When the sensor 16 is configured to be movable to the retracted position and the cleaning position simultaneously, the sensor 16 can be cleaned by the cleaning member 33 and the detection surface 16*a* is prevented from being contaminated, thereby preventing the formed image from being degraded by the contaminated detection surface 16*a*. In addition, because both the retracting and cleaning of the sensor 16 can be performed at the same time by a single operation to open the cover 101, operability is improved. Because of the above single operation, the structure of the whole apparatus may be simplified and a compact and low cost apparatus is created compared to a case in which an additional operation member is separately provided.

Further, the cover 101 can be opened or closed for the purpose other than the replacement of the transfer device 7. For example, the cover 101 may be opened for a replacement of a waste toner box and removal of a jammed sheet inside the image forming apparatus. In particular, if the cover is configured to be opened or closed for various purposes, when the number of times that the cover is opened or closed increases, the number of times that the detection surface 16*a* of the sensor 16 is cleaned also increases. Accordingly, the degradation in the quality of the formed image due to the smears of the detection surface 16*a* of the sensor 16 is effectively prevented.

Figure 17:
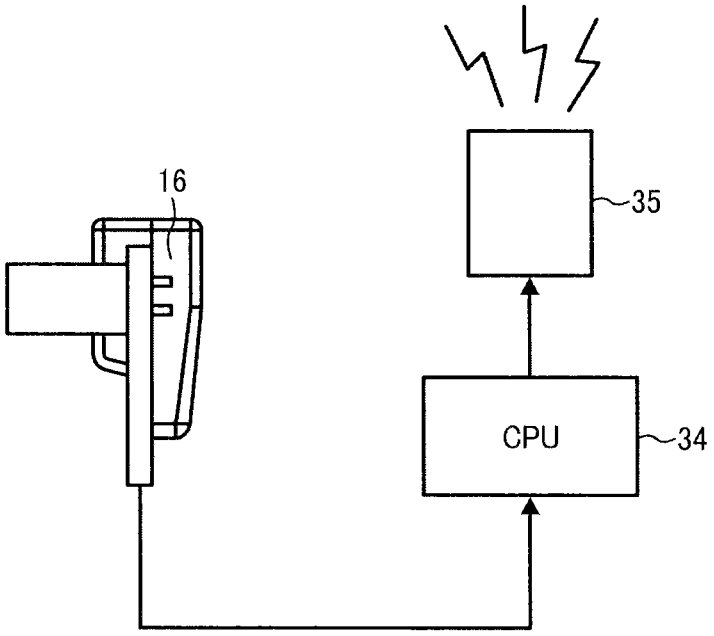
FIG. 17 is a view illustrating further another embodiment including a contamination detector and a notifier.

Further, as illustrated in FIG. 17, the image forming apparatus according to the present embodiment may include a contamination detector 34 to detect smears of the sensor 16 and a notifier 35 to notify that the sensor 16 has been smeared when the contamination detector 34 detects smears. The contamination detector 34 is for example implemented by a CPU installed in the apparatus 100 and detects smears of the sensor 16 by comparing strength or output value of a signal input from the sensor 16 to a previously-set threshold. In addition, various methods may be selected for the notification by the notifier 35, such as a notification performed by a display appeared on a control panel disposed on the apparatus 100 or by light using a light source, or alternatively a notification by sound using a speaker.

Thus, by providing the contamination detector 34 and the notifier 35, when the sensor 16 is contaminated, a user may be prompted to clean the sensor 16 or the opening and closing of the cover 101 so that the sensor 16 may be kept clean.

Because the positioning device according to the present embodiment of the present invention is configured as above, even when misalignment occurs due to the tolerances of any parts, the support member 17 is positioned relative to the transfer device 7 by making both to contact each other at at least two positions and the sensor 16 can be accurately positioned with respect to the intermediate transfer belt 8. With this configuration, the inclination of the sensor 16 with respect to the surface of the intermediate transfer belt 8 is optimized and the reading precision of the sensor 16 can be improved.

Advantageously, even though the compression spring 21 is disposed at a side of the second contact portion 22B, the support member 17 can be rotated based on the contact position of the second contact portion 22B set as a reference position. As a result, it is not necessary to secure a large distance between both contact portions 22A, 22B and the compression spring 21, thereby realizing a space-saving, compact apparatus.

The present invention is not limited to the above-described embodiments and various changes and modification are possible without deviating from the subject matters of the present invention. In the above embodiment, a case in which the configuration of the present invention is applied to the sensor positioning device to detect image patterns formed on the intermediate transfer belt is described. However, the present invention is not limited to this type of sensor positioning device. For example, the configuration of the present invention may be applied to an image forming apparatus in which the sensor is disposed opposed to the rotary member such as the sheet conveyance belt or the photoreceptor and the image pattern is formed on the surface of the sheet conveyance belt or the photoreceptor.

Figure 18:
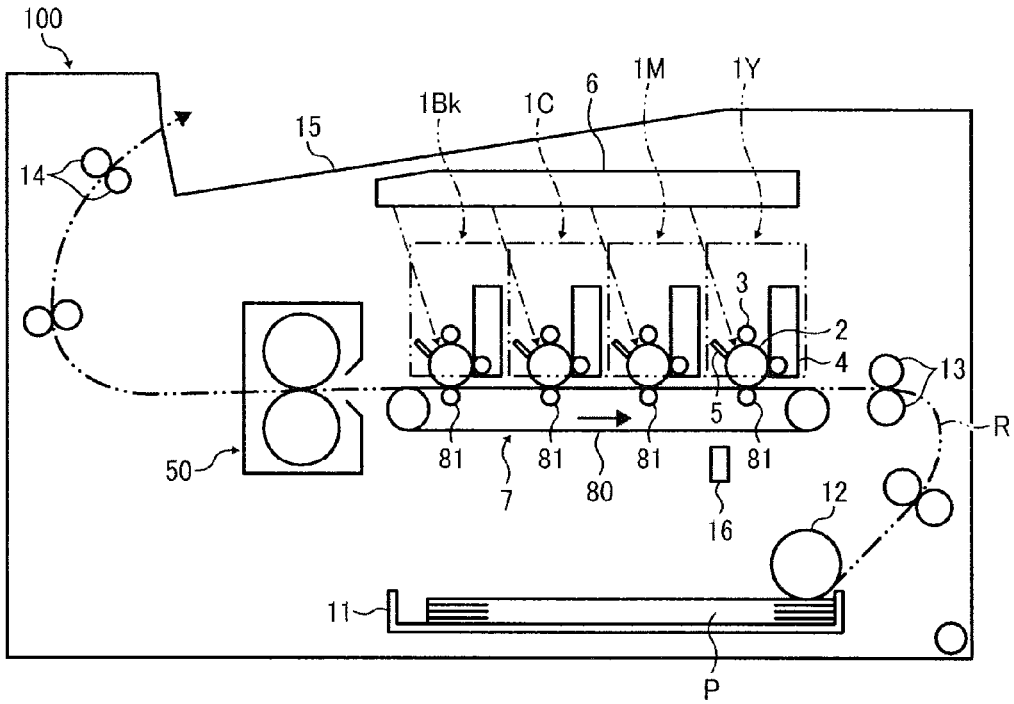
FIG. 18 is an overall configuration of the image forming apparatus, in which an image pattern on a conveyance belt is detected.

FIG. 18 shows a schematic configuration of the image forming apparatus, in which the sensor 16 is disposed opposed to the sheet conveyance belt 80 and configured to detect the image pattern on the sheet conveyance belt 80.

In this case, the toner image formed on each photoreceptor 2 in each of the image forming units 1Y, 1M, 1C, and 1Bk is transferred to a sheet on the sheet conveyance belt 80 at positions of a plurality of transfer rollers 81. Further, the sheet is conveyed from the sheet tray 11 by the sheet feed roller 12 and others to the sheet conveyance belt 80. In FIG. 18, a part which is supplied with a same reference numeral in the aforementioned embodiment includes the same function and a redundant explanation thereof will be omitted.

Further, when correction of the image density and the image position are performed in the present embodiment, the image pattern is formed on the photoreceptor 2 in each of the image forming units 1Y, 1M, 1C, and 1Bk, and each image pattern is transferred to the sheet conveyance belt 80 at each position of the transfer rollers 81. Then, when the image pattern reaches the position opposed to the sensor 16 following the rotation of the sheet conveyance belt 80, the image pattern is detected by the sensor 16 and, based on detected information, the image density and the image position are corrected.

Figure 19:
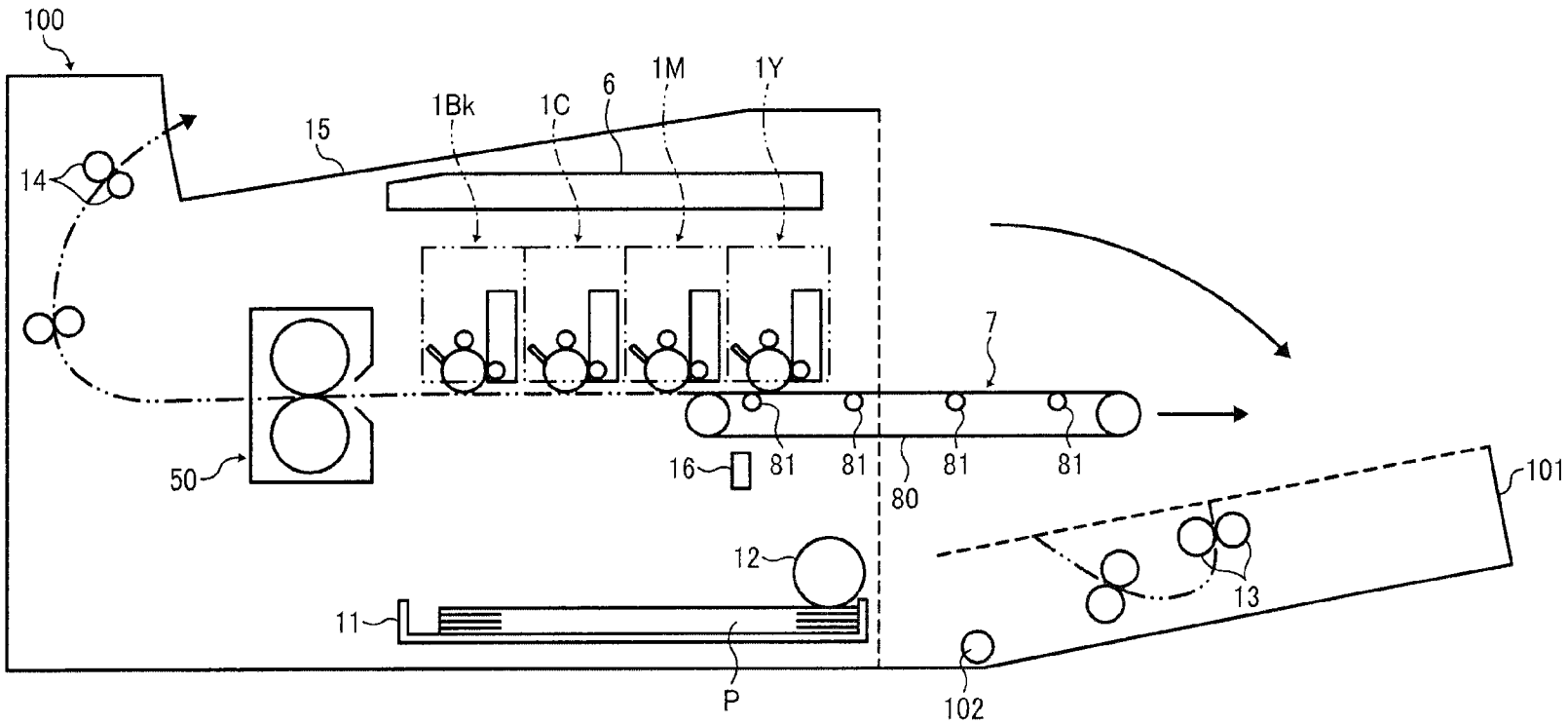
FIG. 19 is a view illustrating how to detach the transfer device from the image forming apparatus of FIG. 18.

In addition, as illustrated in FIG. 19, the cover 101 disposed at a front of the apparatus 100 is configured to rotate about the support shaft 102 similarly to the aforementioned embodiment. In this case, when the cover 101 is rotated to be left open as shown by a broken line in the figure, the pair of registration rollers 13 and the like are retracted from a front side of the sheet conveyance belt 80 along with the cover 101. In this state, the transfer device 7 including the sheet conveyance belt 80 and the transfer rollers 81 is horizontally removable from the apparatus 100.

In the thus-configured image forming apparatus, application of the sensor contact/separation device of the present invention allows both the evacuation of the pattern detector and the cleaning of the sensor to be performed simultaneously by a single operation of opening the cover 101, thereby improving operability and realizing a compact, low-cost apparatus.

In addition to detecting the image pattern on the surface of the sheet conveyance belt or the intermediate transfer belt as described above, the sensor may be used to detect an abrasion status of a surface of any rotary member such as the sheet conveyance belt, intermediate transfer belt, or photoreceptor.

The positioning device of the present invention may be used for not only the structure in which the sensor is contacted or separated from the rotary member but also for the structure to position a first member relative to a second member. When the first member to be positioned relative to the second member is disposed close to the second member, the first member may be disposed either in a non-contacted state or contacted state relative to the second member. The image forming apparatus to which the positioning device of the present invention is applied includes, without limitation to the color laser printer, a monochrome image forming apparatus, copier, facsimile machine, or multifunction apparatus combining the functions of the above devices.

Additional modifications and variations of the present invention are possible in light of the above teachings. It is therefore to be understood that, within the scope of the appended claims, the invention may be practiced other than as specifically described herein.

What is claimed is:

1. A positioning device to position a first member relative to a second member, comprising:

two convex parts disposed on a side of the first member and apart from each other; and positioning portions disposed on a side of the second member so as to contact the convex parts, each of which is disposed apart from each other and opposed to each of the two convex parts, wherein the positioning portions include two planar portions disposed substantially perpendicularly with respect to a direction to allow the first member to approach the second member, and a slanted portion disposed in the vicinity of one of the two planar portions and angled with respect to the direction to allow the first member to approach the second member, wherein the second member is an endless belt, on a surface of which an image pattern for detection is formed, and wherein the first member is a sensor to detect the image pattern formed on the endless belt.

2. A positioning device to position a first member relative to a second member, comprising:

two convex parts disposed on a side of the first member and apart from each other;

positioning portions disposed on a side of the second member so as to contact the convex parts, each of which is disposed apart from each other and opposed to each of the two convex parts, wherein the positioning portions include two planar portions disposed substantially perpendicularly with respect to a direction to allow the first member to approach the second member, and a slanted portion disposed in the vicinity of one of the two planar portions and angled with respect to the direction to allow the first member to approach the second member; and a rotary shaft, wherein the first member is rotatably supported, and the two convex parts are disposed apart from each other in a direction crossing the rotary shaft of the first member.

3. A positioning device to position a first member relative to a second member, comprising:

two convex parts disposed on a side of the first member and apart from each other;

positioning portions disposed on a side of the second member so as to contact the convex parts, each of which is disposed apart from each other and opposed to each of the two convex parts, wherein the positioning portions include two planar portions disposed substantially perpendicularly with respect to a direction to allow the first member to approach the second member, and a slanted portion disposed in the vicinity of one of the two planar portions and angled with respect to the direction to allow the first member to approach the second member;

a biasing device to bias the first member to approach the second member;

a cam follower fixed to a member other than the first member; and a cam to slidably contact the cam follower so as to move the first member to a direction separating from the second member against a biasing force of the biasing device, wherein the biasing device is disposed nearer to the convex part disposed in the vicinity of the slanted portion among the two convex parts.

4. The positioning device as claimed in claim 1, wherein one of the convex parts first contacts one of the planar portions in the vicinity of which the slanted portion is not disposed and the other convex part next contacts the slanted portion or the other of the planar portions in the vicinity of which the slanted portion exists when the first member is approached the second member.

5. The positioning device as claimed in claim 1, wherein a leading end of each of the two convex parts is formed into a circular arc.

6. The positioning device as claimed in claim 1, wherein the two convex parts are formed of a material having a slidable property.

7. The positioning device as claimed in claim 1, wherein the second member is configured to be removable from an image forming apparatus, and a tip portion of the slanted portion is disposed inside an exterior of the second member or a member integrally formed with and removable from the second member or at the same level of the exterior of the second member.

8. The positioning device as claimed in claim 1, wherein the two planar portions and the slanted portion are disposed on a same member.

9. An image forming apparatus comprising a positioning device as claimed in claim 1.

10. An image forming apparatus comprising:

a first member;

a second member;

a first supporter to support the first member;

a second supporter to support the second member;

two convex parts disposed on the first supporter and apart from each other; and positioning portions disposed on the second supporter so as to contact the convex parts, each of which is disposed apart from each other and opposed to each of the two convex parts, wherein the positioning portions include two planar portions disposed substantially perpendicularly with respect to a direction to allow the first member to approach the second member, and a slanted portion disposed in the vicinity of one of the two planar portions and angled with respect to the direction to allow the first member to approach the second member, wherein the second member is an endless belt, on a surface of which an image pattern for detection is formed, and wherein the first member is a sensor to detect the image pattern formed on the endless belt.

11. The positioning device as claimed in claim 1, further comprising:

a support member to support the sensor; and a first side plate disposed at a first end of the support member, wherein the two convex parts are disposed at the first side plate.

12. The positioning device as claimed in claim 11, further comprising:

a second side plate disposed at a second end of the support member, the second end being an opposite end of the first end, wherein the two convex parts are disposed at both the first side plate and the second side plate.

13. The positioning device as claimed in claim 1, further comprising:

a frame member; and a belt retention member fixed to the frame member, the belt retention member supporting an inner peripheral surface of the endless belt, wherein one of the two planar portions is provided on the frame member.

14. The positioning device as claimed in claim 13, wherein the other one of the two planar portions is provided on the belt retention member.

15. The positioning device as claimed in claim 13, wherein the slanted portion is formed on a projection part disposed on the frame member.

16. The positioning device as claimed in claim 5, wherein a diameter of a circular arc of one of the two convex parts, which is disposed farther from the slanted portion than the other one of the two convex parts, is greater than that of the other one of the two convex parts.

17. The positioning device as claimed in claim 1, wherein the slanted portion is disposed between the two planar portions.

18. The positioning device as claimed in claim 1, further comprising:

a rotary shaft, wherein the first member is rotatably supported, and the two convex parts are disposed apart from each other in a direction crossing the rotary shaft of the first member.

19. The positioning device as claimed in claim 1, further comprising:

a biasing device to bias the first member to approach the second member;

a cam follower fixed to a member other than the first member; and a cam to slidably contact the cam follower so as to move the first member to a direction separating from the second member against a biasing force of the biasing device, wherein the biasing device is disposed nearer to the convex part disposed in the vicinity of the slanted portion among the two convex parts.

20. The image forming apparatus as claimed in claim 10, further comprising:

a rotary shaft, wherein the first member is rotatably supported, and the two convex parts are disposed apart from each other in a direction crossing the rotary shaft of the first member.

* * * * *